United States Patent [19]

Strafello

[11] 4,414,892

[45] Nov. 15, 1983

[54] OFFSET PRINTING

[76] Inventor: Nicholas Strafello, 150 Charles St., Malden, Mass. 02148

[21] Appl. No.: 379,053

[22] Filed: May 17, 1982

[51] Int. Cl.[3] ..... B41F 17/00

[52] U.S. Cl. ..... 101/44; 101/35; 101/335

[58] Field of Search ..... 101/35, 36, 37, 38 R, 101/38 A, 247, 41–44, 335

[56] References Cited

U.S. PATENT DOCUMENTS

| | | | |
|---|---|---|---|
| 2,280,328 | 4/1942 | Weltmer et al. | 101/35 |
| 2,584,092 | 1/1952 | Keller et al. | 101/38 R |
| 3,045,588 | 7/1962 | Jordan et al. | 101/38 R |
| 3,286,623 | 11/1966 | Verik | 101/38 A X |
| 3,294,015 | 12/1966 | Gartside | 101/35 |
| 3,453,982 | 7/1969 | Carl | 101/38 R X |
| 3,827,356 | 8/1974 | Snow et al. | 101/35 |
| 3,929,066 | 12/1975 | Pillon | 101/35 |
| 4,271,757 | 6/1981 | Maxwell et al. | 101/37 |

*Primary Examiner*—Clifford D. Crowder
*Attorney, Agent, or Firm*—Charles Hieken

[57] ABSTRACT

An offset marking system includes a marking wheel depending from an indexing motor adjacent to a window in a tube that carries components to be marked. A print wheel is rotatably mounted in a bearing. The indexing motor and bearing are slidably mounted on supports between a spring and a motor-operated cam. A rotating ink roller conveys ink from an ink reservoir to the print wheel. As an alternative to the motor-operated cams, a solenoid-operated level pivoted about an axis in the plane of the print wheel and marking wheel selectively moves the print wheel and marking wheel apart and together by acting on the bearing and indexing motor.

6 Claims, 7 Drawing Figures

OFFSET PRINTING

The present invention relates in general to offset printing and more particularly concerns novel apparatus and techniques for making small components, such as integrated circuits, that have been tested in a production line environment.

A typical prior art approach for marking such devices involves mkaing costly mechanical modifications to existing printing machines, such as Markem machines generally of the type disclosed in U.S. Pat. No. 4,271,757. These modified machines are not infrequently down for both adjustment and repair. These machines have relatively complex drive gears and chain or belt drives that contribute to the relatively large downtime for repair and adjustment. Furthermore, the rate of production is limited by the motor rotational speed (or GEAR RATIO).

A search of subclasses 35–37, 116, 181 and 248 of class 101 uncovered the following U.S. Pat. Nos. as being most pertinent: 4,271,757, 4,246,840, 3,921,519, 3,752,067, 3,736,870, 3,685,442, 3,457,854, 3,294,015.

It is an important object of the invention to provide improved methods and means for offset printing.

According to the invention, there is marking pad means for receiving an ink symbol for transfer to a component, print wheel means for providing said ink symbol to said marking pad means, inking means for providing ink to said print wheel means, means for translating said print wheel means back and forth between said inking means and said marking pad means, means for translating said marking pad means back and forth between said print wheel means and window means for exposing a component to be marked.

According to a more specific form of the invention the inking means comprises an ink reservoir that wets an ink roller, typically rotated by a 2.5 rpm clock motor. A first translatable and rotatable means carries the print wheel means and translates back and forth between the ink roller and the marking pad means. A second translatable and rotatable means carries the marking pad means and translates back and forth between the print wheel means and the window means. The window means is typically in a feed tube that exposes components to be marked one-by-one as they move through the feed tube.

A typical means for translating comprises a first motor for rotating a first cam that moves the first translatable and rotatable means back and forth. A second motor supports a second cam that moves the second translatable and rotatable means back and forth. Means are provided for synchronizing the operations to effect the following steps in the marking process according to the invention.

The first cam pushes the first translatable and rotatable means toward the ink roller so that a predetermined symbol on the print wheel means receives ink from the ink roller. At the same time the second cam advances the second translatable and rotatable means toward the window means so that a symbol previously received on the marking pad means is urged through the window means in the feed tube against the component to mark the component. Then indexing motor means rotate the print wheel means and the marking pad means so that a previously inked symbol is positioned for transfer from the print wheel means to the marking pad means as the first and second cams rotate so that means, such as first and second springs, urge print wheel means and marking pad means together to effect transfer of an inked symbol to the marking pad means. The first and second cam means then move print wheel means and marking pad means apart while the indexing motor means rotate to position the print wheel means for inking and the marking pad means for marking.

There are a number of alternative approaches. For example, a single indexing motor may index both the print wheel means and the marking means when the two are frictionally engaged. Instead of the motor-cam arrangement for translating the print wheel means and the marking pad means, a solenoid-operated lever arrangement may be used.

Numerous other features, objects and advantages of the invention will become apparent from the following specification when read in connection with the accompanying drawing in which.

Figure 1:
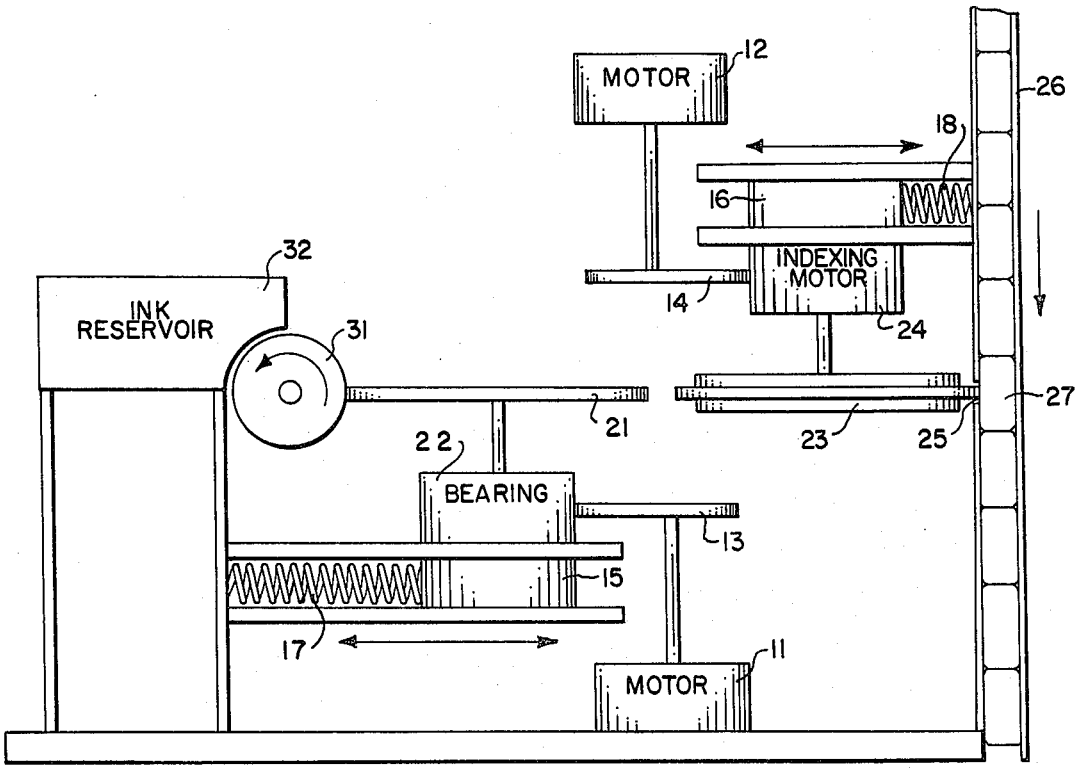
FIG. 1 is a diagrammatic representation of a system according to the invention.

With reference now to the drawing and more particularly FIG. 1 thereof, there is shown a diagrammatic representation of an offset system according to the invention. Lower and upper drive motors 11 and 12 rotate lower and upper cams 13 and 14, respectively. As the shafts of motors 11 and 12 rotate, cams 13 and 14 push rotary bearing mounting block 15 and indexing motor mount block 16 laterally to compress lower spring 17 and upper spring 18, respectively. When cams 13 and 14 rotate to their apogee point, print wheel 21 carried by rotary bearing 22 and marking pad wheel 23 carried by indexing motor 24 move apart with marking pad 23 entering a window or gap 25 in feed tube 26 to engage and mark an electronic component 27, such as an integrated circuit. At the same time print wheel 21 engages ink roller 31 that receives an epoxy ink from ink reservoir 32 to ink a symbol to be transferred to marking pad wheel 23 and then imprinted on a component. Ink roller 31 rotates slowly, typically being driven by a 2.5 rpm clock motor, to absorb ink from ink reservoir 32. The ink is uniformly distributed across the surface of ink roller 31 by being passed from reservoir 32 through a narrow slit not specifically shown in FIG. 1, but in a manner well-known in the art.

Figure 3:
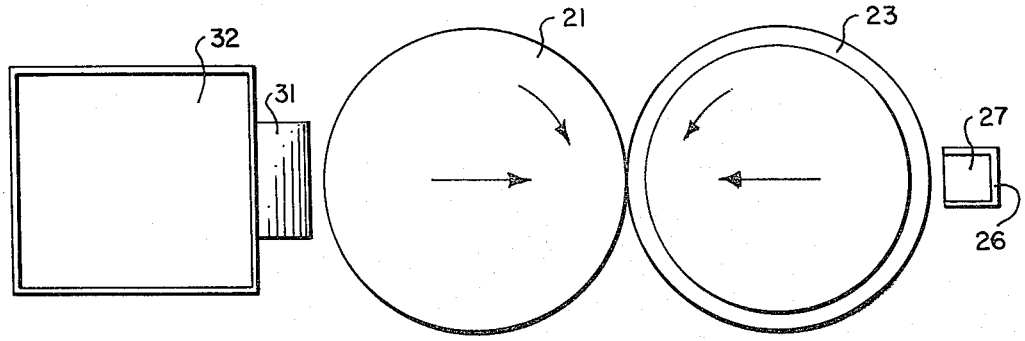
FIG. 3 is a diagrammatic representation showing print wheel and marking pad wheel in contact.

As drive motors 11 and 12 continue to rotate cams 13 and 14, springs 17 and 18 urge blocks 15 and 16 together until print wheel 21 contacts marking pad wheel 23 as shown in FIG. 3 to transfer an inked symbol from print wheel 21 to marking pad wheel 23.

When print wheel 21 and marking pad wheel 23 contact, drive motors 11 and 12 are deenergized. Indexing motor 24 is then energized to rotate marking pad wheel 23 a predetermined increment, typically 15°. Print wheel 21 mounted in bearing mount 22 rotates the same increment because it functions as a coupled idler. At the point of contact fresh ink is squeezed from the print wheel 21 to the marking pad wheel 23. This indexing completes the print cycle. The cycle is repeated.

Although this specific embodiment discloses two cams each driven by a separate motor, it is within the principles of the invention to drive both cams by one motor. It is also within the principles of the invention to use two indexing motors, although it is preferred to drive both print wheel 21 and marking pad wheel 23 with a single motor for economy reasons and to simplify the apparatus.

Figure 2:
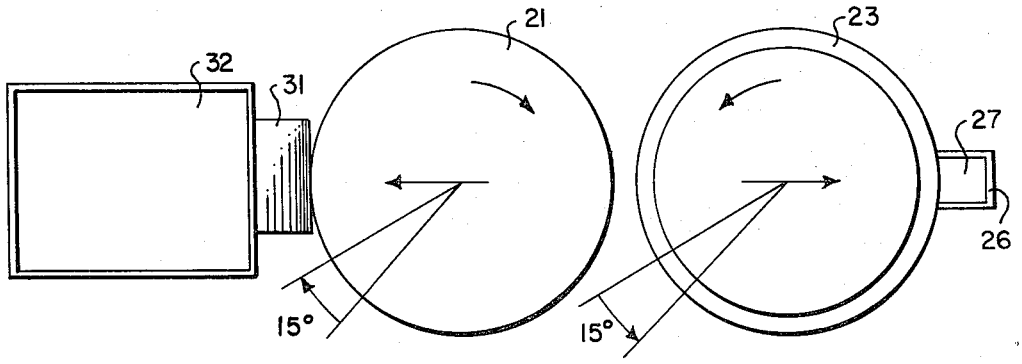
FIG. 2 is a diagrammatic representation of print wheel and resilient marking pad wheel when separated so that a print wheel symbol is inked and the resilient marking pad marks.
Figure 4:
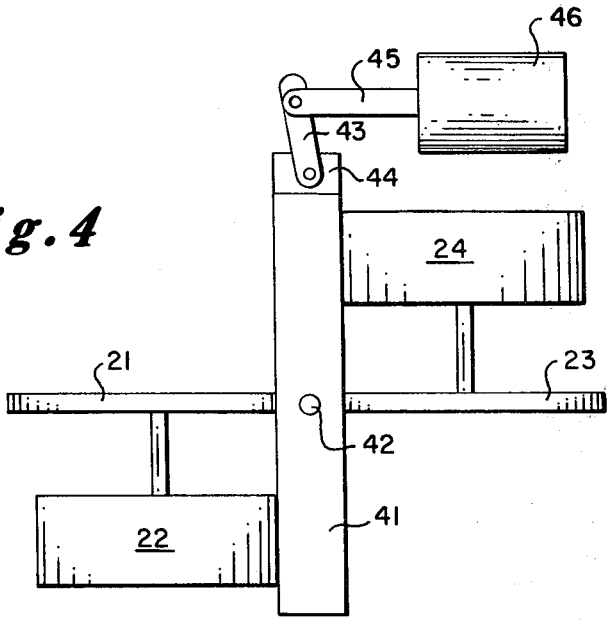
FIGS. 4 and 5 show an alternate embodiment of the invention using a solenoid-actuated lever system to move print wheel and marking pad wheel together and apart, respectively.
Figure 5:
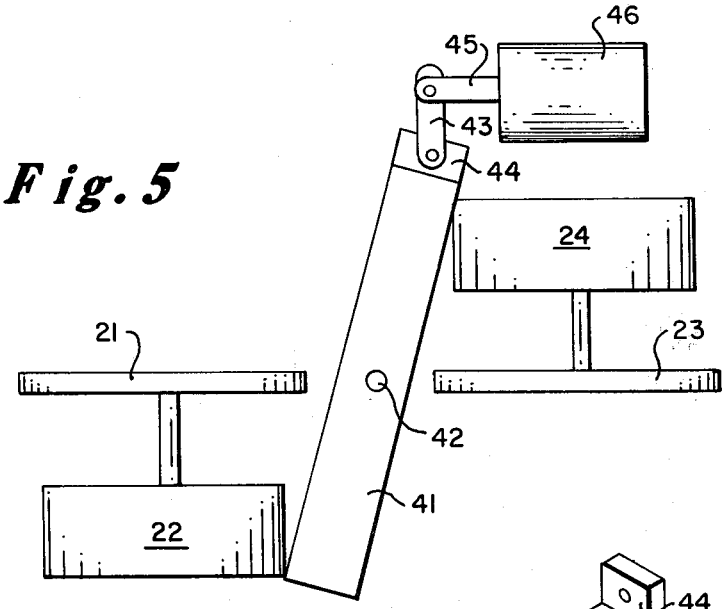
Figure 6:
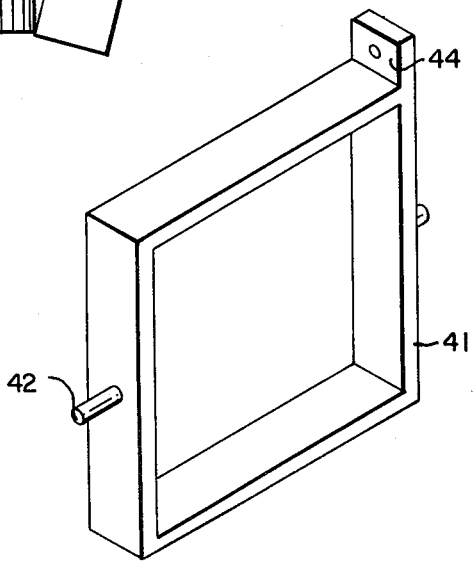
FIG. 6 is a perspective view of a lever yoke cut away in the center and pivoted in the center of both vertical structures.

Referring to FIGS. 4 and 5, there is shown a diagrammatic representation of an alternative means for relatively displacing print wheel 21 and marking wheel 23 with a solenoid-actuated lever arrangement. A yoke 41 that is open in the center to allow print wheel 21 and marking wheel 23 to contact there is mounted centrally between print wheel 23 and marking wheel 24 and pivoted about pins 42 between print wheel 21 and marking wheel 23. FIG. 6 shows a perspective view of leverage yoke 41. A link 43 interconnects the extended end 44 of yoke 41 to solenoid plunger 45 of solenoid 46. When solenoid plunger 45 is extended as shown in FIG. 4, print wheel 21 contacts marking wheel 23. When solenoid plunger 45 is withdrawn as shown in FIG. 5, print wheel 21 and marking wheel 23 are separated and occupy the positions substantially as shown in FIG. 2. Energizing solenoid 46 withdraws plunger 45 into the core and moves print wheel 21 and marking wheel apart. Deenergizing solenoid 46 allows springs 17 and 18 (FIG. 1) to urge print wheel 21 and marking wheel 23 into contact as described above.

While the system described above may be operated manually or automatically by any suitable computer or other control system, it is advantageous to initiate a print cycle as each electronic component 27 moves into position opposite window 25. The techniques for effecting a print cycle for each such displacement are well-known in the art and not broadly a part of this invention.

Figure 7:
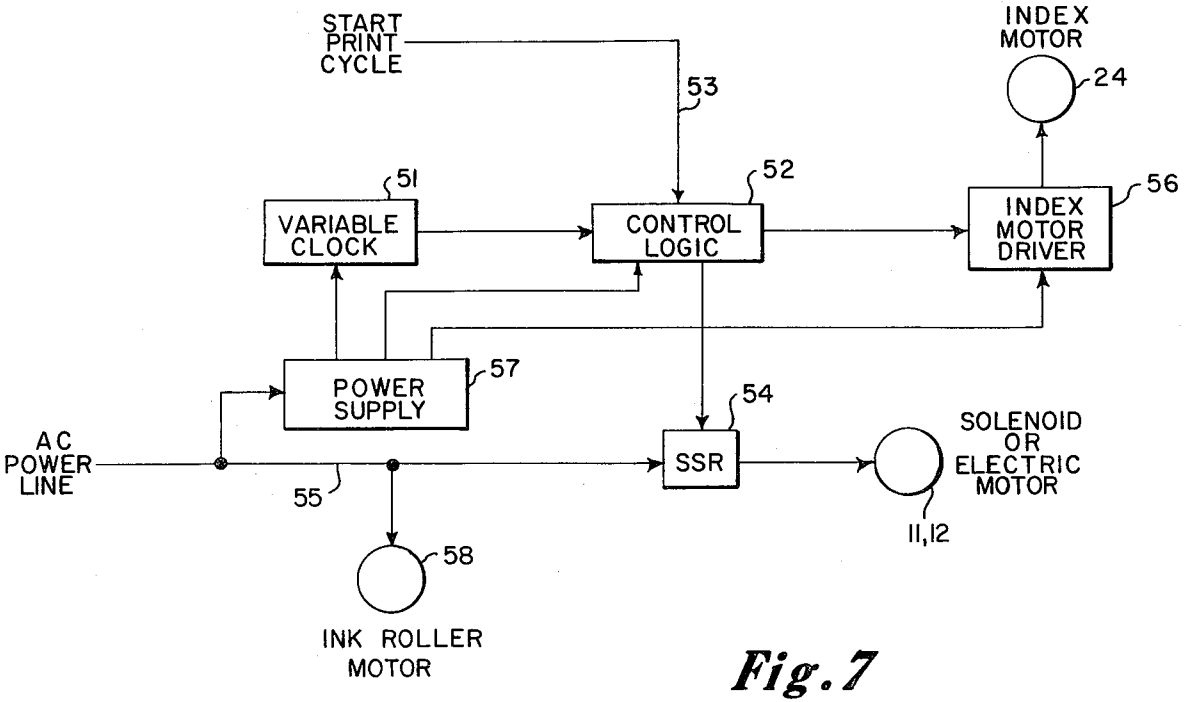
FIG. 7 is a block diagram illustrating the logical arrangement of an electronic control system for actuating the machine.

Referring to FIG. 7, there is shown a block diagram illustrating the logical arrangement of a system for energizing the different components of the system. A variable clock 51 typically comprises a free-running pulse generator with an adjustable rate that provides clock pulses as long as it is energized. Control logic 52 processes the clock pulses in response to a start print cycle signal received on line 53, typically provided when the electronic components such as 27, have been advanced so that the next component is opposite window 25 for receiving an impression from marking wheel 23. In response to the start print cycle signal on line 53, control logic 52 provides a signal to solid-state relay 54 to close the latter and deliver A.C. power from line 55 to drive motors 11 and 12 in the embodiment of FIG. 1 or to solenoid 46 with the modification illustrated in FIGS. 4–6. The signal from control logic 52 keeps solid-state relay 54 closed for the time required to effect the motions of a cycle as described above for the drive motors and solenoid. Control logic 52 then provides a signal to index motor driver 56 to cause the latter to drive indexing motor 24. After indexing motor 24 has been indexed a predetermined amount, control logic 52 disables index motor driver 56 to complete the printing cycle. Power supply 57 delivers D.C. potentials to variable clock 51, control logic 52 and index motor driver 56. A.C. power line 55 drives ink roller motor 58 directly.

There has been described novel apparatus and techniques for marking electronic components rapidly, reliably and with apparatus relatively free from complexity and subject to relatively little downtime. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Offset marking apparatus comprising, print wheel means for receiving marking fluid, marking wheel means for receiving marking fluid from said print wheel means and transferring it to a component to be marked, means for supporting said print wheel means and said marking wheel means for relative displacement between a first position when said print wheel means and said marking wheel means are in contact and a second position when said print wheel means and said marking wheel means are separated, marking fluid delivery means for delivering marking fluid to said print wheel means when in said second position, window means for receiving said marking wheel means when in said second position, means for relatively displacing said print wheel means and said marking wheel means between said first and second positions, and means for angularly displacing said print wheel means and said marking wheel means when in said first position to transfer marking fluid from said print wheel means to said marking wheel means, said means for relatively displacing said print wheel means and said marking wheel means comprising, means for supporting said print wheel means and said marking wheel means for relative translational motion, spring means acting on said means for supporting for urging said print wheel means and said marking wheel means toward one of said first and second positions, and means acting on said means for supporting for urging said marking wheel means and said print wheel means toward the other of said first and second positions.

2. Offset marking apparatus in accordance with claim 1 wherein said spring means urges said print wheel means and said marking wheel means toward said first position, said means acting on said support means comprises cam means rotatably supported on a motor shaft, and further comprising motor means for rotating the motor shaft to selectively urge said marking wheel means and said print wheel means toward said second position.

3. Offset marking apparatus in accordance with claims 1 or 2 wherein said means for angularly displacing comprises an indexing motor rotatably connected to one of said print wheel means and said marking wheel means, and bearing means for rotatably supporting the other of said print wheel means and said marking wheel means.

4. Offset marking apparatus in accordance with claims 1 or 2 wherein said marking fluid delivery means comprises, an ink reservoir, an ink roller for receiving ink from said ink reservoir, means for rotating said ink roller, and means for supporting said ink roller for contact with said print wheel means when in said second position.

5. Offset marking apparatus in accordance with claim 1 wherein said means acting on said means for supporting comprises lever means pivotally mounted for acting on said means for supporting, solenoid means coupled to said lever means for providing actuating energy to said lever means, and means for selectively energizing said solenoid means to selectively move said print wheel means and said marking wheel means into a selected one of said first and second positions.

6. Offset marking apparatus in accordance with claim 5 wherein said means for angularly displacing comprises an indexing motor rotatably connected to one of said print wheel means and said marking wheel means, and bearing means for rotatably supporting the other of said print wheel means and said marking wheel means.

* * * * *